US006068557A

United States Patent [19]

Zeilinger

[11] Patent Number: 6,068,557

[45] Date of Patent: May 30, 2000

[54] HANGER FOR SECURING A SWING CHAIN OR THE LIKE

[75] Inventor: Brian K. Zeilinger, Janesville, Wis.

[73] Assignee: Playstar, Inc., Janesville, Wis.

[21] Appl. No.: 09/289,041

[22] Filed: Apr. 9, 1999

[51] Int. Cl.[7] ..... A63G 9/00

[52] U.S. Cl. ..... 472/118; 411/400

[58] Field of Search ..... 472/118, 120, 472/121, 122, 123, 124, 125; 411/400, 401; 248/58, 63

[56] References Cited

U.S. PATENT DOCUMENTS

| | | | |
|---|---|---|---|
| 254,397 | 2/1882 | Smith | 411/400 |
| 2,516,975 | 8/1950 | Gazella | 155/63 |
| 2,699,201 | 1/1955 | Levy | 155/58 |
| 2,800,949 | 7/1957 | Horowitz | 155/58 |
| 2,977,118 | 3/1961 | Farkas | 272/60 |
| 3,145,024 | 8/1964 | Grudoski | 272/87 |
| 3,427,024 | 2/1969 | Cross | 272/87 |
| 4,014,540 | 3/1977 | Caulkins | 272/85 |
| 4,018,538 | 4/1977 | Smyrni et al. | 403/346 |
| 4,138,104 | 2/1979 | D'Amicis | 272/85 |
| 5,326,326 | 7/1994 | Cunard et al. | 472/118 |
| 5,364,312 | 11/1994 | Cunard et al. | 472/118 |
| 5,413,298 | 5/1995 | Perreault | 248/228 |

OTHER PUBLICATIONS

*Playland, Inc.* date unknown.
*Play Designs* date unknown.
*Olympic Recreation, Inc.* date unknown.

*Primary Examiner*—Kien T. Nguyen
*Attorney, Agent, or Firm*—Michael Best & Friedrich LLP

[57] ABSTRACT

The invention provides a playstation and a hanger for connecting a children's play accessory to the playstation. The hanger includes a first end portion that has threads formed on an outer surface and a second portion that has a first loop formed as part of the second portion. The hanger further includes a second loop that is connected to either, or both, the first end portion and/or the second portion. The second loop is preferably located between the first end portion and the second end portion of the hanger. The first loop is preferably oriented in a first plane that is substantially perpendicular to the longitudinal axis of the first end portion. The second loop is preferably oriented in a second plane that is substantially perpendicular to the first plane.

22 Claims, 2 Drawing Sheets

HANGER FOR SECURING A SWING CHAIN OR THE LIKE

BACKGROUND OF INVENTION

The invention relates to a hanger for connecting a swing chain or the like to a playstation, and more particularly to a hanger that connects a chain for a swing or another children's play accessory to two locations on a playstation.

A variety of children's play accessories (e.g., swings, riders and gymnastics equipment) are attached to playstations by hanging them from a support (usually a cross-beam) on the playstation. The accessories are hung using one or more link-type chains. The chains are hung by connecting one end of the link chain to an S-type hook (or some other conventional form of attachment) and then securing the S-type hook to a hanger that is connected to the support structure on the playstation.

Conventional hangers typically secure chains to one location on the playstation. That is, for each hanger, there is only one set of threads extending into the support structure of the playstation to secure the hanger to the playstation. An eye-bolt is one example of a hanger that is used to secure a chain to a playstation. The eye-bolt screws directly into the support structure of a playstation at one end and the loop at the opposite end is secured to a connector (e.g., an S-hook) that is attached to a chain. Only the threads of the eye-bolt are screwed into the playstation. A simple shear stress (i.e., a downward force on the bolt) could cause the support structure around the threads to shear or strip.

SUMMARY OF THE INVENTION

Accordingly, the invention provides a playstation and a hanger for connecting a children's play accessory to the playstation. The hanger includes a first end portion that has threads formed on an outer surface and a second portion that has a first loop formed as part of the second portion. The hanger further includes a second loop that is connected to either (or both) the first end portion and/or the second portion.

In one embodiment of the invention, the second loop is connected between the first end portion and the second portion of the hanger. The first loop is oriented in a first plane that is substantially perpendicular to the longitudinal axis of the first end portion. In addition, the second loop is positioned in a second plane that is substantially perpendicular to the first plane.

The present invention also relates to a playstation that includes a cross-beam and a hanger. The first end portion of the hanger is threaded into a surface on the cross-beam positioning the first loop of the hanger substantially parallel to the surface of the cross-beam.

The cross-beam may include a first member that has a first surface and a second member that has a second surface where the first surface and the second surface are substantially parallel. The threads of the hanger are screwed into the first surface of the first member such that the first loop is positioned substantially parallel to the second surface of the second member. A bolt extends through the first loop in order to secure the hanger to the playstation at a second location (in addition to the threaded first end portion). The additional connection is provided without the use of any additional brackets or other parts reducing the cost and labor associated with connecting a hanger to a playstation. The second loop is oriented substantially perpendicular to the first surface of the first member permitting the second loop to receive a connector (e.g., an S-hook) that is attached to a chain or some other type of tether.

A principal advantage of the invention is to provide a hanger that is easily secured to a playstation in two locations on the playstation.

Another advantage of the invention is to provide a hanger that is easily assembled to a playstation.

Another advantage of the invention is to provide a hanger for connecting a chain or the like to a playstation where the hanger has a one-piece configuration.

Still another advantage of the invention is to provide a playstation that includes a hanger which is secured to two members on a cross-beam of the playstation.

Other features and advantages of the invention are set forth in the following drawings, detailed description, and claims.

The foregoing description of the present invention has been presented for purposes of illustration and description. The description is not intended to limit the invention to the form disclosed herein.

Consequently, variations and modifications commensurate with the above teachings, and the skill or knowledge of the prior art, are within the scope of the present invention. The embodiments described herein are intended to explain the best modes for practicing the invention and to enable others skilled in the art to utilize the invention in the disclosed or other embodiments, and with various modifications required by the particular applications or uses of the present invention. It is intended that the appended claims be construed to include alternative embodiments to the extent permitted by the prior art.

DETAILED DESCRIPTION OF THE PREFERRED EMBODIMENTS

Figure 1:
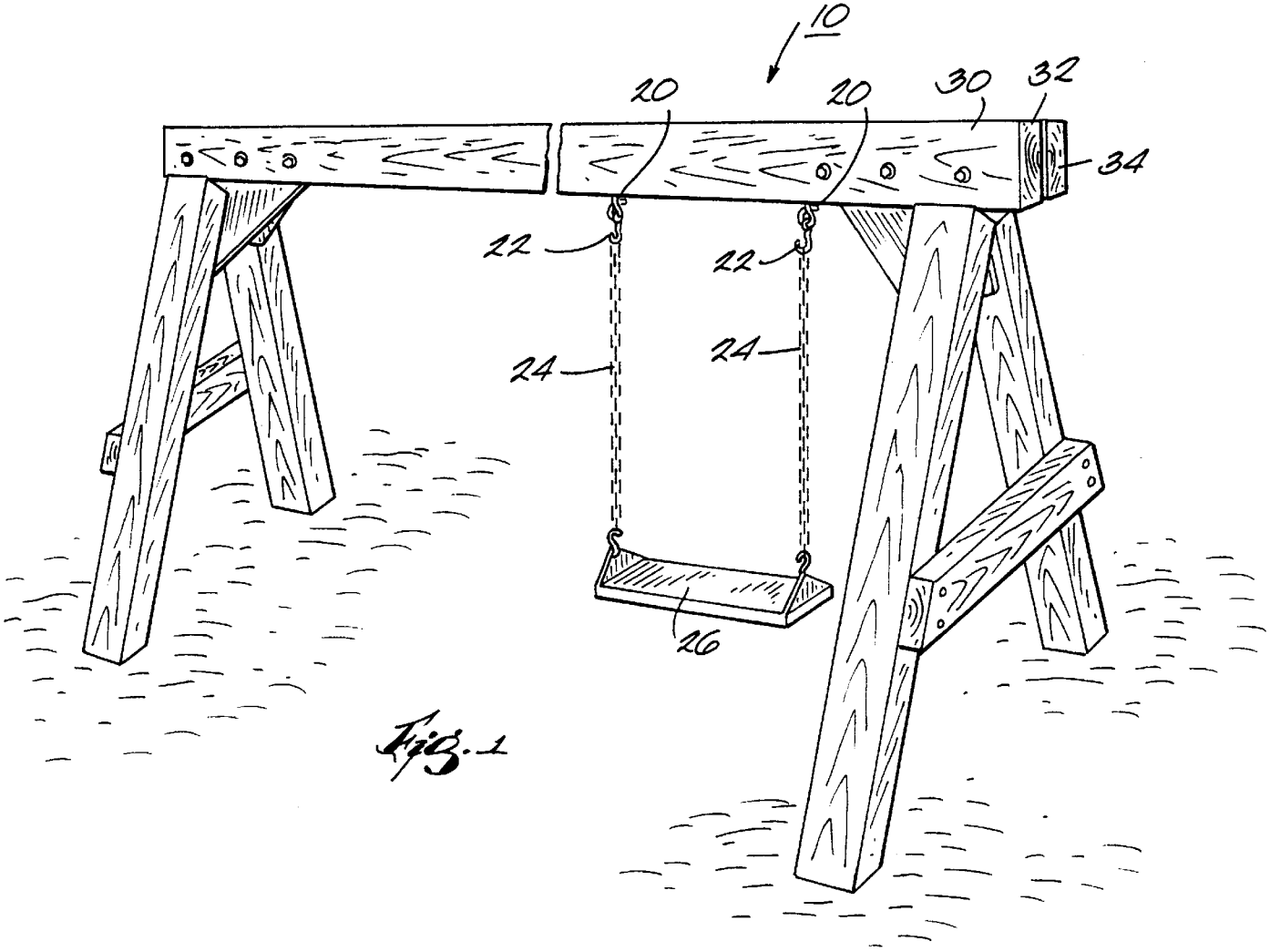
FIG. 1 is a front perspective view of a playstation of the present invention.

A playstation 10 according to the present invention is illustrated in FIG. 1. The playstation 10 includes a cross-beam 30 and one or more hangers 20 which are secured to the cross-beam 30. The hangers 20 are typically attached to connectors 22 which are, in turn, secured to chains 24. Chains 24 are used to support some type of children's play accessory (a swing 26 is shown in FIG. 1). The hangers 20 are typically secured into the bottom of the cross-beam 30, although they may be secured to any portion of the playstation 10. The hangers 20 are identical, and accordingly, only the single hanger shown in FIGS. 2–4 will be described in detail.

Figure 4:
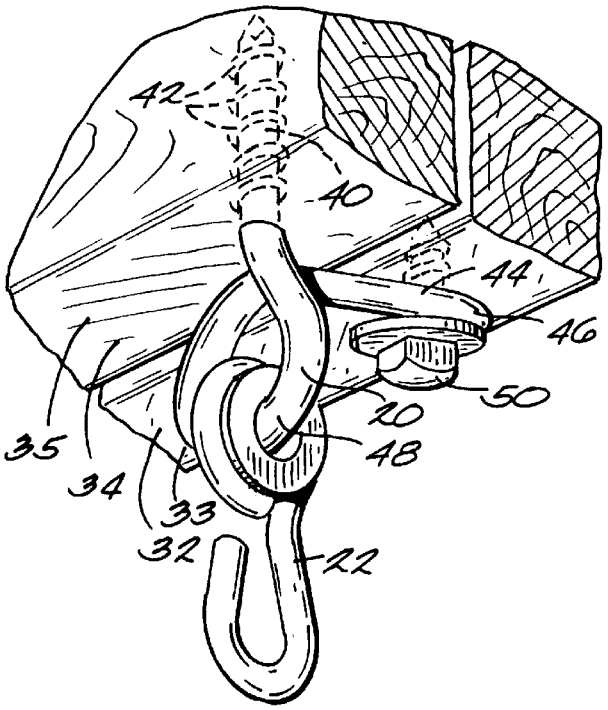
FIG. 4 is a perspective view of the hanger of FIG. 2 inserted into a cross-beam that includes a first member and a second member.
Figure 2:
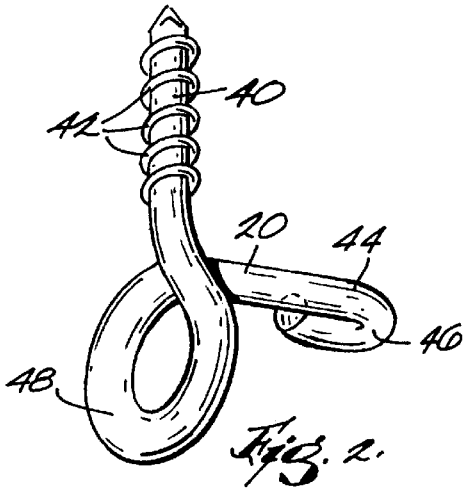
FIG. 2 is a perspective view of a hanger of the present invention.
Figure 3:
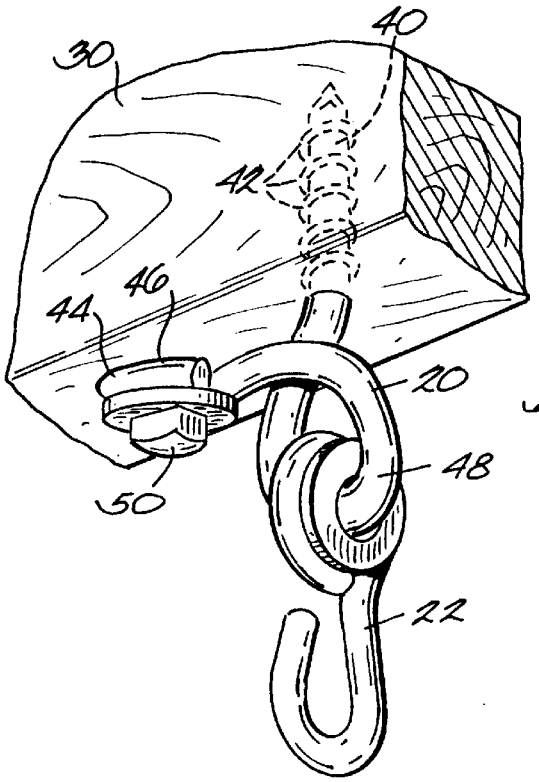
FIG. 3 is a perspective view of the hanger of FIG. 2 inserted into a cross-beam.

As shown in FIG. 2, the hanger 20 includes a first end portion 40 that has an outer surface with threads 42 formed thereon. The hanger 40 further includes a second end portion 44 that has a loop 46 formed thereon. The hanger 20 also includes a second loop 48 that is preferably positioned between the first end portion 40 and the second end portion 44 (as shown in FIGS. 2–4). The first loop 46 lies in a first plane that is substantially perpendicular to the longitudinal axis of the first end portion 40. The second loop 48 lies in a plane that is substantially perpendicular to the first plane. The second loop 48 is constructed to receive a connector 22, which is, in turn, secured to the chain 24 (not shown in FIGS. 2–4).

As shown in FIG. 3 the threads 40 are screwed into the cross-beam 30 such that the first loop 46 is positioned near (or preferably against) the cross-beam 30. The hanger 20 is secured to the cross-beam 30 at a second location by extending a bolt 50 through the second loop 48 into the cross-beam 30.

A portion of a preferred form of the playstation 10 is shown in FIG. 4. The cross-beam 30 includes a first member 34 having a first surface 35 and a second member 32 having a second surface 33. The threaded portion 42 of the first end portion 40 is screwed into the first surface 35 of the first member 34 such that the first loop 46 is positioned adjacent and substantially parallel to the second surface 33 of the second member 32. The bolt 50 extends through the first loop 46 and into the second surface 33 of the second member 32. The hanger 20 is therefore secured to both the first member 34 (via threads 42) and the second member 32 (via bolt 50). The second loop 48 of the hanger 20 is oriented substantially perpendicular to the first surface 35 of the first member 34, although the second loop 48 could be formed in some other orientation.

In another form of the invention, the first end portion 40 and/or the bolt 50 could have threaded ends that are secured to the cross-beam 30 using a nut (not shown). In this case, the bolt 50 and the threads 42 of the first end portion 40 extend through the cross-beam 30 and are secured on the opposite side (not shown) of the beam with appropriate nuts.

Various features and advantages of the present invention are set forth in the following claims.

What is claimed is:

1. A hanger for connecting a play accessory to a playstation having a surface, the hanger comprising:

a first longitudinal end portion having an axis, an outer surface, and threads formed on the outer surface;

a second portion including a first loop, said first loop having a first cross-section; and a second loop connected to at least a one of the first end portion and the second portion, said second loop having a second cross-section that substantially matches the first cross-section of the first loop.

2. The hanger according to claim 1 wherein the second loop is adapted to secure a tether.

3. The hanger according to claim 1 wherein the second loop is connected between the first end portion and the second portion.

4. The hanger according to claim 1 wherein the threads are adapted to be screwed into the surface of the playstation.

5. The hanger according to claim 1 wherein the first loop is positioned in a first plane that is substantially perpendicular to the longitudinal axis of the first end portion.

6. The hanger according to claim 5 wherein the second loop is positioned in a second plane that is substantially perpendicular to the first plane.

7. The hanger according to claim 1 further comprising a bolt extending through the first loop, the bolt includes an axis that is substantially parallel to the axis of the first end portion.

8. A playstation comprising:

a cross-beam; and a hanger including, a first longitudinal end portion having an axis, an outer surface, and threads formed on the outer surface, the thread being threaded into the cross-beam;

a second portion having a first loop; and a second loop connected to at least a one of the first end portion and the second end portion.

9. The playstation according to claim 8 further comprising a tether secured to the second loop of the hanger.

10. The playstation according to claim 8 wherein the hanger is a one-piece configuration.

11. The playstation according to claim 8 wherein the cross-beam includes a surface and the first loop of the hanger is positioned near the surface of the cross-beam.

12. The playstation according to claim 11 wherein the first loop of the hanger is positioned against the surface of the cross-beam.

13. The playstation according to claim 8 wherein the cross-beam includes a first member having a first surface and a second member having a second surface.

14. The playstation according to claim 13 wherein the first surface of the first cross-beam and the second surface of the second cross-beam are substantially parallel.

15. The playstation according to claim 14 wherein the first surface of the first cross-beam and the second surface of the second cross-beam are substantially horizontal.

16. The playstation according to claim 13 wherein the threads of the hanger are screwed into the first member.

17. The playstation according to claim 13 wherein the first loop is positioned in a first plane that is substantially parallel to the second surface of the second member.

18. The playstation according to claim 13 wherein the second loop is positioned in a plane that is substantially perpendicular to the first surface of the first member.

19. The playstation according to claim 13 further comprising a nut adapted to mate with the threads of the hanger, wherein the hanger extends through the first member and is secured to the first member by fastening the nut.

20. The playstation according to claim 13 further comprising a bolt extending through the first loop into the second member.

21. The playstation according to claim 8 further comprising a bolt extending through the first loop into the cross-beam.

22. A hanger for connecting a play accessory to a playstation that includes a cross-beam having a surface, the hanger comprising:

a first longitudinal end portion, an outer surface, and threads formed on the outer surface for screwing the hanger into the surface of the cross-beam;

a second portion including a first loop having an axis; and a second loop connected to at least one of said first end portion and said second portion, said second loop being positioned in a plane that is substantially parallel to said axis of said first loop.

* * * * *